US008113825B2

(12) United States Patent
Ormond

(10) Patent No.: US 8,113,825 B2
(45) Date of Patent: Feb. 14, 2012

(54) COMPUTER-CONTROLLED PYROTECHNIC MATRIX DISPLAY

(76) Inventor: Neal Ormond, Palo Alto, CA (US)

( * ) Notice: Subject to any disclaimer, the term of this patent is extended or adjusted under 35 U.S.C. 154(b) by 462 days.

(21) Appl. No.: 12/012,651

(22) Filed: Feb. 5, 2008

(65) Prior Publication Data

US 2008/0206695 A1 Aug. 28, 2008

Related U.S. Application Data

(60) Provisional application No. 60/899,960, filed on Feb. 6, 2007.

(51) Int. Cl.
*F23D 5/00* (2006.01)

(52) U.S. Cl. ..... 431/196; 431/178; 431/285; 431/348; 102/210; 102/215; 126/500

(58) Field of Classification Search ..... 431/196, 431/348, 126, 77, 350; 102/210, 215; 40/552; 239/17; 126/500
See application file for complete search history.

(56) References Cited

U.S. PATENT DOCUMENTS

| | | | | | |
|---|---|---|---|---|---|
| 1,645,206 | A * | 10/1927 | Stevens | 44/530 |
| 1,976,844 | A * | 10/1934 | Fisher | 40/552 |
| 4,737,100 | A * | 4/1988 | Schnell et al. | 431/3 |
| 5,961,042 | A * | 10/1999 | Doyle | 239/12 |
| 6,062,848 | A * | 5/2000 | Lifshits | 431/285 |
| 7,153,129 | B2 * | 12/2006 | Bussman et al. | 431/348 |
| 2003/0113677 | A1 * | 6/2003 | Doud | 431/77 |

* cited by examiner

*Primary Examiner* — Steven B McAllister
*Assistant Examiner* — Avinash Savani
(74) *Attorney, Agent, or Firm* — Wolff & Samson PC

(57) ABSTRACT

A computer-controlled matrix of pixels that emit bursts of fire in a controlled manner to create moving images and text on a plane in front of the matrix. The unit houses a number of pixels in a grid array, with each pixel associated with a solenoid gas valve. The valves are supplied by a main gas bus and when actuated release gas to an individual pixel, where it flows out and over a constantly burning pilot light and combusts. The valves are connected through a main circuit box to a computer, and are controlled by software that allows the user to script and play complex graphical animations, musical compositions, scrolling text, as well as real-time graphical response to specific user inputs.

16 Claims, 7 Drawing Sheets

COMPUTER-CONTROLLED PYROTECHNIC MATRIX DISPLAY

This application claims the benefit of Provisional Application 60/889,960 filed Feb. 6, 2007, the entire contents of which are incorporated herein by reference.

BACKGROUND OF THE INVENTION

The present invention relates to pyrotechnic displays for use in entertainment and special effects, and more specifically to gas fueled flame effects and computer-controlled pyrotechnics.

Pyrotechnics have been in use for hundreds of years, originally taking the form of solid fuels, but with modem refining techniques, the use of gaseous fuels has become another option, for both energy and for entertainment displays, with numerous benefits over solid fuels, including a lower risk of accidental detonation and the ability to deliver precisely controlled supplies of gas to a burner or other flame device. Even more recently the use of computer control has allowed the operation of highly complex gaseous systems involving valves and electronics supplying precise control to numerous devices, large and small.

The worlds of art and entertainment have put such systems to use to create dynamic Hollywood scenes with precisely timed and placed explosions and fireballs, and to create choreographed fire effects on stage for theater or musical performance. Many flame devices are even refined and intended for use as a stand-alone objet d'art.

The normally unrelated field of display technology has progressed rapidly in the past century to include a number of related methods for electronically or mechanically creating images or words on a dynamic surface. The majority of modem displays involve, at their essence, a grid of tightly packed units, referred to as "pixels", that can be turned to various states of light or dark, translucent or opaque, red, green or blue, according to commands from a graphical controller or storage medium. When large numbers of these pixels are grouped together, they appear to the eye to form coherent images. They can then be dynamically altered dozens of times per second, and due to "persistence of vision", the image is seen to change or move fluidly. To date, methods of pixel formation have included, but are not limited to, using beams of electrons to illuminate phosphors on a screen, using electricity to change opacity of a liquid crystal element, and using light emitting diodes to form individual pixels on a display.

SUMMARY OF THE INVENTION

The present invention relates to a computer-controlled matrix of pixels that emit bursts of fire in a controlled manner to create moving images, text, and percussion on a plane in front of the matrix. The invention is a unit of predetermined size that houses numerous pixels in a rectangular grid array and uses a combustible gas, such as propane, to create fire. Gas is supplied from an external tank(s), and distributed to a bus of solenoid valves onboard the unit that hold back the gas until each is electrically actuated and allows gas to flow through it. Each pixel on the display has a corresponding valve that is connected by tubing directly to an outlet hole at the pixel's location on the screen, and each valve is connected electrically to a control box on the unit. The control box supplies power to each valve in response to control commands from a computer. Onboard the computer is a software program scripted specifically for the pyrotechnic matrix which allows users to select graphics, animations, text, or even real-time input from the computer's human interface to be displayed on the screen instantaneously or recorded for later playback. When running, the software translates the information and sends commands out through a computer port such as the parallel or serial port, to the control box onboard the display, which activates specific valves, which subsequently source gas to the output of the corresponding pixel. This gas passes over a constantly-burning pilot light, which exists offset but in parallel with the grid of pixel outputs, and immediately combusts, creating a fireball and a significant source of light, heat, and sound. With the matrix taken as a whole, the result is a bright, hot, dynamic, and often fleeting image that jumps from the screen in licks and bursts of flame, or an ethereal text of fire that scrolls across the device.

In an alternate embodiment, the device may be used in multiples, whereby any number of individual units may be assembled, transported, and even operated separately for convenience, but stacked and assembled later into one giant device, using the flexibility of the software control to adapt and expand all graphics and text to scale to the desired size. With such methods extremely large screens can be assembled.

Other features and advantages of the present invention will become apparent from the following description of the invention.

DESCRIPTION OF THE DRAWINGS

The present invention may be better understood by referencing the accompanying drawings. For clarity, individual elements have been given common numbering when they appear in multiple drawings.

DETAILED DESCRIPTION OF THE INVENTION

The following is a detailed description of illustrative embodiments of the present invention. As these embodiments are described in reference to the drawings, various modifications or adaptations of the methods and/or specific structures described may become apparent to those skilled in the art. All such modifications, adaptations, or variations that rely upon the teachings of the present invention, and through which these teachings have advanced the art, are considered to be within the spirit and scope of the present invention. For example, the devices set forth herein have been characterized as flat, rectangular screens, but it is apparent that any shape or form, of 2 dimensions or 3, may be created by similar means. Hence, these descriptions and drawings are not to be considered in a limiting sense as it is understood that the present invention is in no way limited to the embodiments illustrated.

The present invention provides a computer-controlled matrix of pixels that emit bursts of fire in a controlled manner to create moving images and text on a plane in front of the matrix. Many display technologies exist that utilize large numbers of discrete pixels of light or color in a varied state of intensity, which when grouped together in a grid and seen as a whole appear to the eye to form an image, and can be altered many times a second to create the illusion of motion in the image. This invention utilizes a small burst of fire to constitute each pixel, and when grouped together in large numbers and controlled by software, the pixels are able to form the image of text and graphics that jump from the screen in licks and bursts of flame, as well as creating complex acoustical rhythms. The device is connected to and controlled by a computer with software that allows the user to fine-tune and operate the screen in real-time, or to record sequences for later playback.

Onboard the device, an array of solenoid valves holds back pressurized flammable gas, such as propane, from an external source. Upon receiving commands from the computer, the circuit board on the device activates a number of these valves, which release gas to a specific pixel on the screen, where it flows horizontally outward and over a constantly burning pilot light, thereby igniting and creating a small fireball (or plume if the gas is allowed to continue to flow) which creates much light, heat, and a percussive sound. The pilot lights are supplied by a constant flow of oxygenated gas, giving a small blue flame with much less luminous output than the bright yellow fireballs of each pixel. The purpose of this is to allow the omnipresent pilot lights to recede into darkness in the presence of specific bright pixels being fired, and to not muddy or distort the image being created by those pixels.

Figure 1:
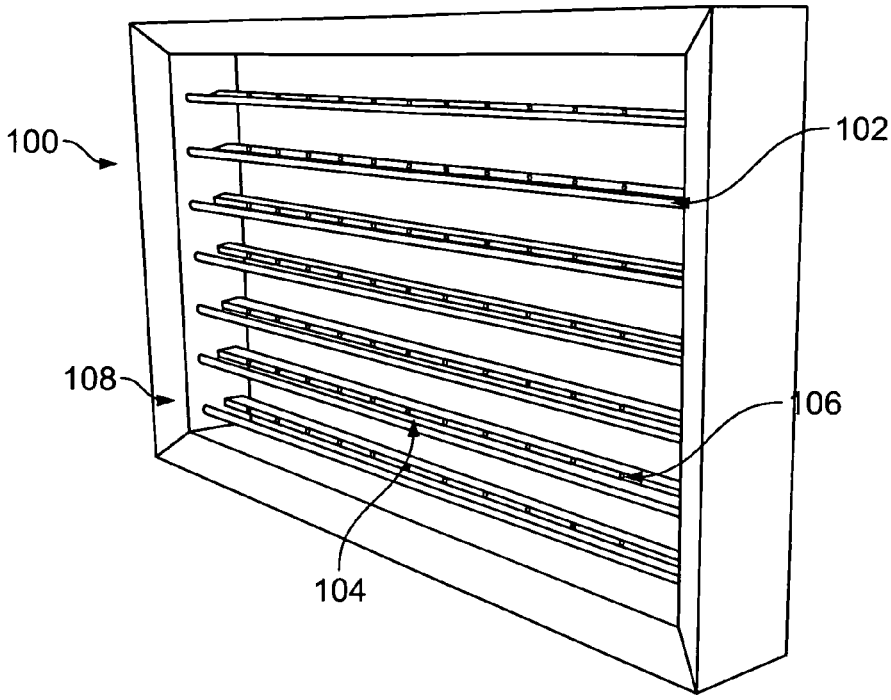
FIG. 1 is a perspective view of the pyrotechnic matrix incorporating principles of the invention.

FIG. 1 is a perspective view of a pyrotechnic matrix 100. The shape of the entire screen is rectangular, with an aspect ratio roughly that of a widescreen television, though as mentioned, virtually any form may be taken by the screen. In this embodiment, a frame 108 outlines the screen, provides most of the structural support, and houses all the workings of the system. Running horizontally from one side of the frame to the other are a number (ideally 7 or more) of crossbars 104 and pilot light tubes 102.

Figure 2:
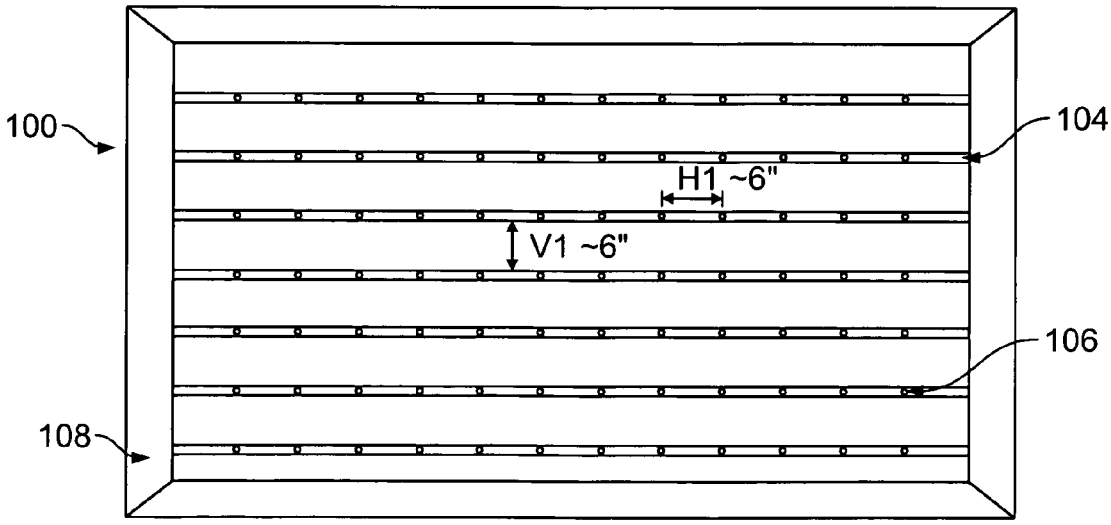
FIG. 2 is a front view of the device, with pilot light tubes excluded for clarity in viewing the pixels and crossbars set behind the pilot light tubes.

FIG. 2 is a front view of the device, with the pilot light tubes 102 excluded for clarity in viewing the crossbars 104 set directly behind them. Protruding at regular intervals of approximately 6 inches from the crossbars 104 are the termini of each of the pixel tubes 106, roughly 0.25 inches in diameter. While the exact spacing 'H1' of the pixel tubes from each other along the crossbars, as well as the vertical spacing "V1" of the crossbars from each other, is not critical (depending on the type of valves 118 described later, the diameter of pixel tubes 106, and the pressure of the gas, an approximate spacing of 6 inches provides the highest quality image), what is important is that those dimensions H1 and V1 remain equal, or close to it, in order to maintain equal spacing of the pixels and an appropriate aspect ratio in the images produced onscreen.

Figure 3:
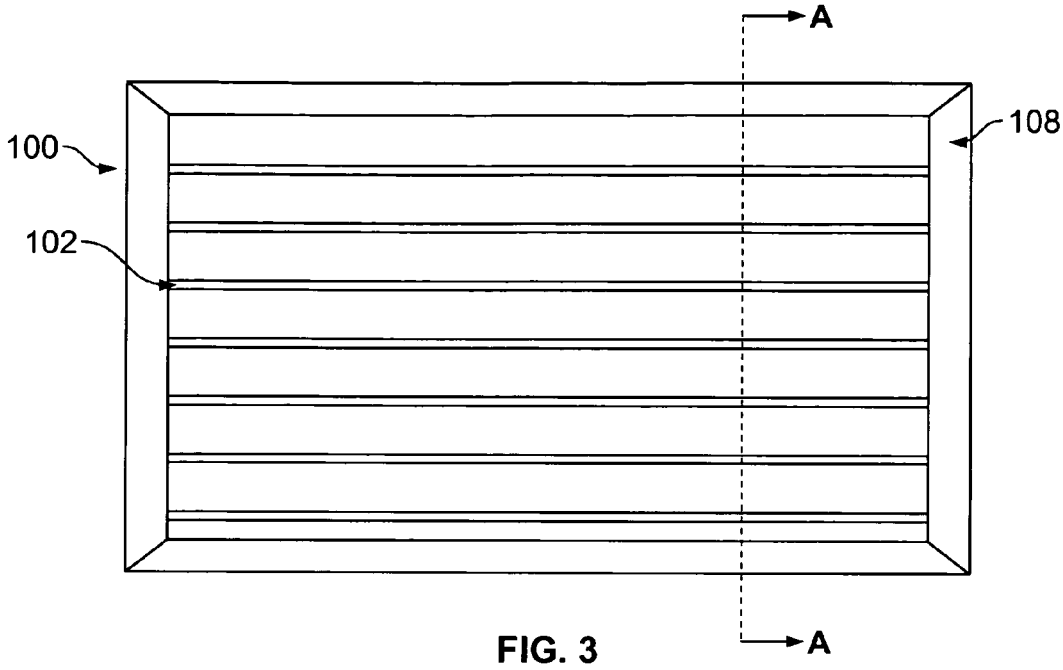
FIG. 3 is a front view of the device, with pixels and crossbars omitted for clarity in viewing the pilot light tubes.

FIG. 3 is a front view of the device, with the crossbars 104 and the pixel tubes 106 omitted for clarity in viewing the pilot light tubes 102. The pilot lights are constructed of metal with a row of closely-spaced small holes spanning the length of their upper sides, and run from one side of the frame 108 to the other, passing through holes in the inner wall of the frame.

Figure 4:
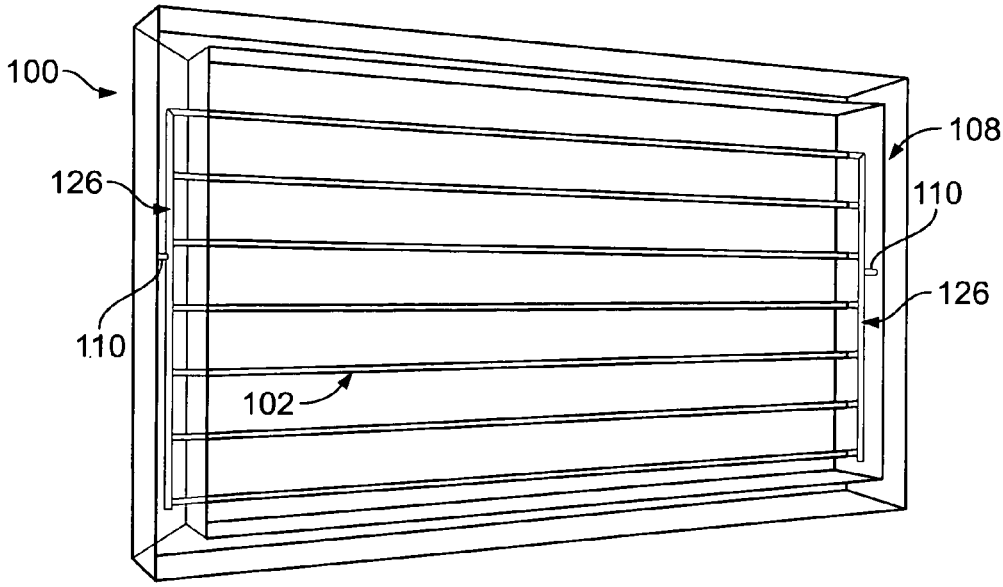
FIG. 4 is a rear perspective view showing the full configuration of the pilot light tube assembly set within the frame, with crossbars and pixels omitted for clarity.

FIG. 4 is a rear perspective view showing the full configuration of the pilot light tube assembly set within the frame 108, with the crossbars and the pixel tubes omitted for clarity. Within the enclosed area inside the frame 108, the pilot light tubes 102 connect on each end to a common bus, or supply tube, 126. Given the dynamics of pilot light gas flow described below, the bus tubes 126 should be of slightly larger diameter (approx 1 inch) than the pilot light tubes 102 (approx 0.75 inch). Set roughly midway along the bus tubes are the pilot light gas inlets, through the venturi 110. The venturi 110 oxygenate the gas by restricting a high-pressure supply of gas behind a very small aperture, creating a tiny high-velocity jet of gas which, upon exiting the aperture, utilizes what is known as the "Venturi Effect" to suck in air from the surrounding atmosphere through an array of holes lying parallel to the direction of gas flow through the valve and tube. The result of the addition of oxygen to the gas is a more efficient burn, creating a hotter, bluer flame. With less excess carbon these blue flames emit quantitatively much less light, and with the pilot light gas tuned to run at a low rate, the pilot lights exist as a row of tiny blue flames dancing along the length of the tube, and insignificant in comparison to the more luminescent yellow pixel bursts.

Figure 6:
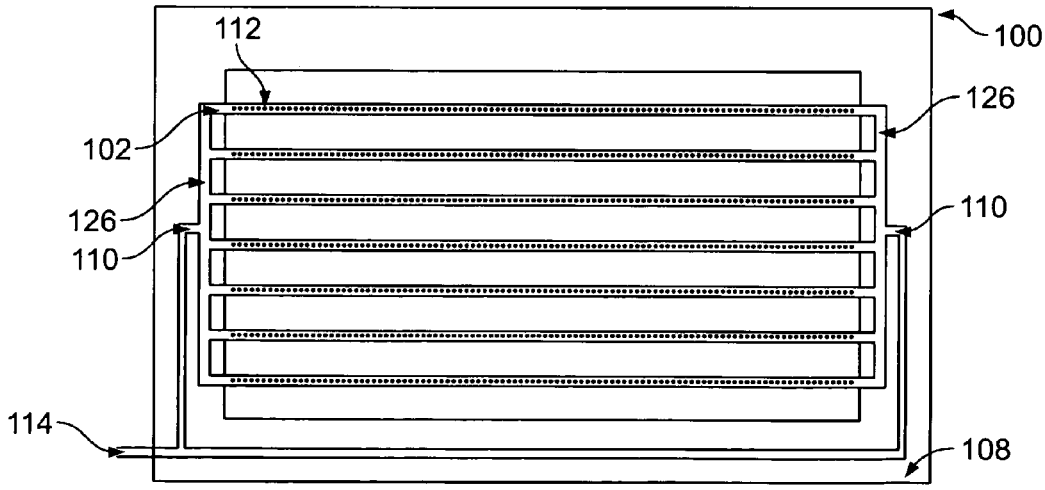
FIG. 6 is a schematic illustrating the layout of the pilot gas supply and distribution tubes.

FIG. 6 is a schematic illustrating the layout of the pilot gas supply and distribution tubes. The gas enters the screen 100 through a hose or channel 114 from an external high-pressure (~90 psi) source, and is split into two channels that terminate in the venturi 110 on each side of the device. Since the propane in the pilot light gas supply is denser than the surrounding atmosphere and tends to sink, extra care must be taken to get an even distribution of gas along all of the pilot light tubes 102. With the low flow rate needed for the pilot lights, an uneven distribution of gas will cause some areas of the pilot lights to flicker and even die, or be susceptible to the wind, while others areas with excess gas will actually change from a blue flame to a yellow one, reducing the visibility of the pixels themselves and distorting the image. Maintaining a gradual reduction in the diameter of the channel (as mentioned above, from pilot bus 126 thru pilot tubes 102) through which the pilot light gas is flowing downstream of the venturi 110 helps to maintain a slightly higher pressure in the tubes and therefore a more even distribution of gas is achieved.

Figure 5:
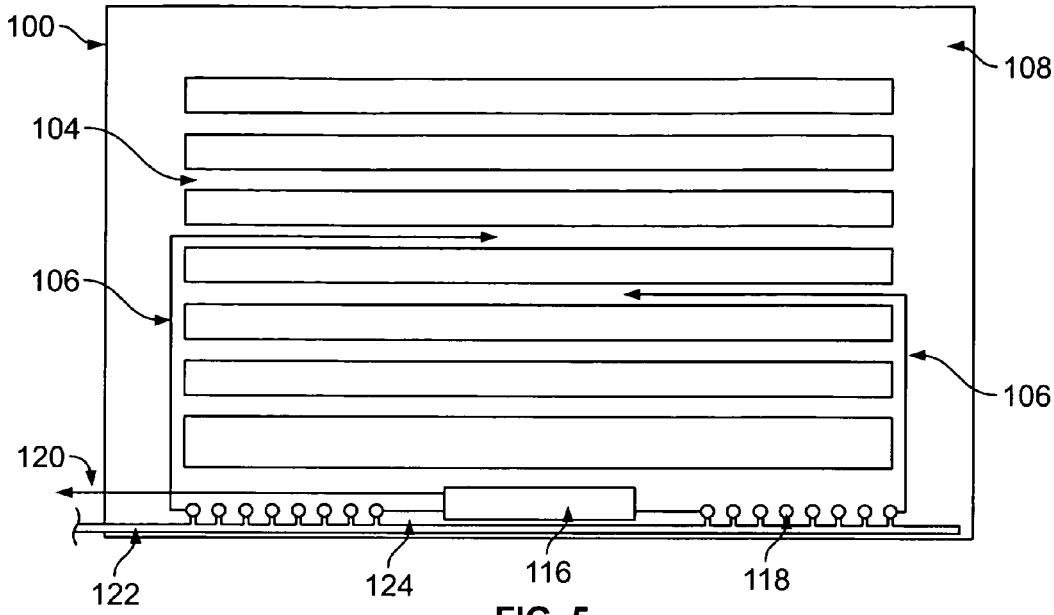
FIG. 5 is a schematic illustrating the layout of the gas supply and bus, valves, pixel tubes, and circuit box within the unit.

FIG. 5 is a schematic illustrating the layout of the gas supply and bus, valves, pixel tubes, and circuit box within the unit. In this embodiment, all valves, electronics, and temperature sensitive materials are positioned in the base of the frame 108, since the heat from the numerous pixels radiates out and upward, leaving the base coolest in temperature and safest for sensitive parts. The solenoid valves 118 are common, low pressure, diaphragm gas valves actuated by an electrical solenoid, and are each attached to a common bus 122. This bus 122 is supplied with gas from an external source, regulated or restricted to a pressure of 5 to 10 psi. Given the large number of valves involved, care must be taken to assure a very free flow of gas to all distribution points of the bus 122, such as constructing parallel bus rows with frequent transverses, much like the layout of city blocks. Furthermore, for safety, the bus array should be constructed of fire-resistant, pressure-rated, rigid conduit, such as steel or copper, and the valves 118 should be attached to it with a similar pressure-rated connection.

Each valve 118 allows gas to flow through it when its solenoid is actuated by an electrical current flowing through wires 124 between each valve 118 and the main electrical circuit box 116. A cable 120 runs out of the electrical box 116 to a point outside the device, where it splits to power and control jacks. The power jack connects to a battery or wall outlet and supplies power for the electrical circuitry and the operation of the valves 118, while the control jack (parallel, serial, or USB) connects to the output of a computer for control commands. Upon being addressed by the computer, a system of electronic "latches" in the circuit box 116 turns power on and off to each of the pixels' valves, and leaves the valves' power in that state (on or off) until each is addressed again by the computer.

After passing through an actuated valve, gas travels through the pixel tubes 106, across the base of the frame 108, up the sides, and across a crossbar 104, eventually making a 90 degree turn and protruding slightly through the wall of the crossbar 104 before terminating at the point on the screen where its assigned pixel is to reside. Due to the radiant heating that the pixel tubes 106 are subjected to, the safest results are obtained if a nonflammable material such as copper is used for the pixel tubes 106.

Figure 7:
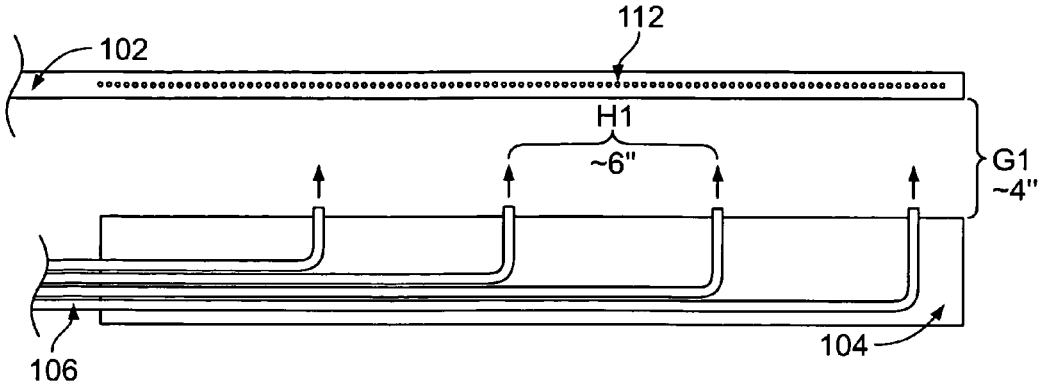
FIG. 7 is a top plan diagram illustrating the layout of pilot light tubes, crossbars, and pixel tubes.

FIG. 7 is a top plan diagram illustrating the layout of the pilot light tubes 102, crossbars 104, and pixel tubes 106. Each crossbar 104 is associated with a pilot light tube 102 set directly in front of it. The pixel tubes 106 stretch up from the base and out along and inside the crossbar 104, concealed for protection and aesthetic simplicity. At the appointed place for each pixel, the pixel tube 106 makes a turn and protrudes through a hole of matching size in the wall of the crossbar 104. The pixel tube 106 then terminates a short distance (~0.25 inch) in front of the face of the crossbar, and may be flared to keep it fixed in place in relation to the crossbar 104. The spacing 'G1' between the pilot light tubes 102 and the pixel tubes 106 can vary but for best effect should be approximately 4 inches. Less of a gap means a faster, narrower jet of gas (and less of a fireball) igniting when reaching the pilot flame. More of a gap means more of a time lag and more variability and less precision in the shape and position of the resulting fireball. At a gap G1 of 4 inches, a happy medium is reached where the gas combusts in a tight, spherical ball, with enough rapidity and simultaneity to create the maximum percussive sound.

The pilot light holes 112 in the tubes 102 are arranged in a straight line at the top of and spanning the length of the tube. Each hole should be 1/16 inch in diameter or smaller, and spaced no more than 1/8 inch from the next hole. Since there are thousands of these pilot light holes throughout the device, even small increases in diameter of the holes can dramatically increase the amount of gas needed to maintain enough pressure and gas flow, and make the minimum size of the pilot flame larger than is desirable. Conversely, too small a hole (below 1/64 inch) can result in too small a flame that is inefficient in igniting bursts of gas from the pixel tubes. Spacing of the pilot holes 112 should not exceed 1/8 inch, as the flames may become susceptible to blowout. The pilot flames exist as a row of slightly overlapping individual blue flames, which when not shielded from wind can easily be blown out. But with all holes 112 being adjacent to the others, the flames take on the ability to re-propagate themselves along the length of a particular tube, and the likelihood of an entire tube being blown out at once and not being able to re-propagate is substantially less.

Figure 8:
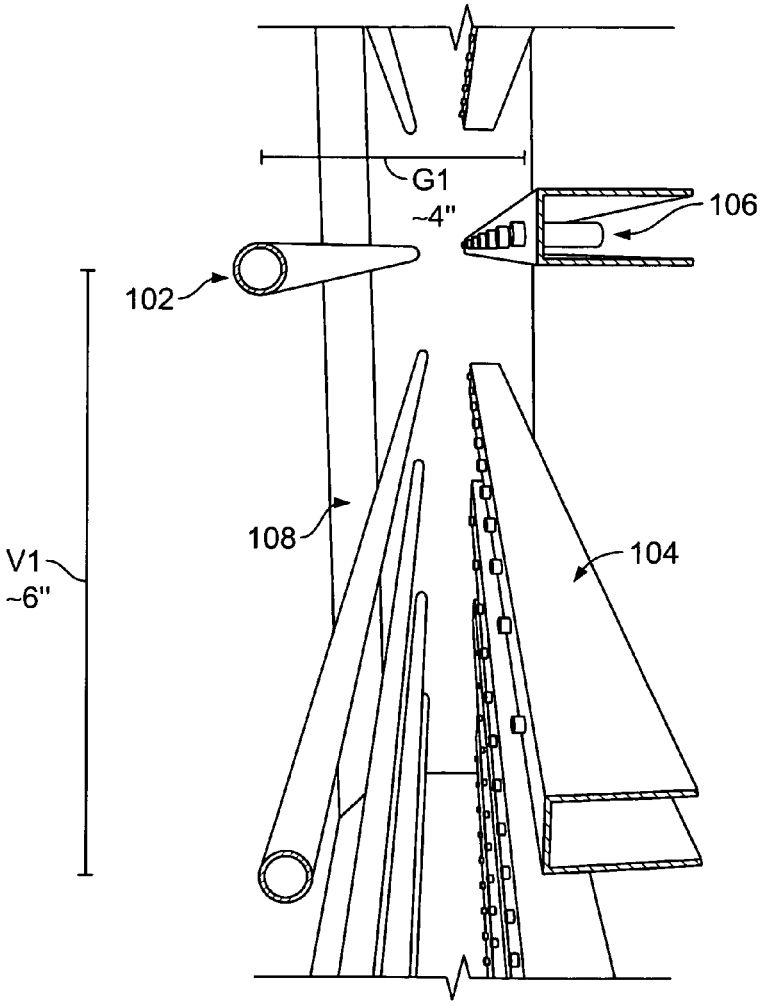
FIG. 8 is a sectional perspective view of the pilot light tubes, crossbars, and pixel tubes, taken in the direction of line A-A in FIG. 3.

FIG. 8 is a sectional perspective view of the pilot light tubes 102, crossbars 104, and pixel tubes 106, taken in the direction of line A-A in FIG. 3. For clarity, the remainder of each pixel tube upstream of the last inch has been omitted, but in reality, each of these tubes turns and travels down the channel and into the frame 108. Again, the pilot light tubes 102 are set forward of the crossbars 104 by about 4 inches, but are also set slightly lower than the crossbars 104, such that a horizontal line extended out the terminus of a pixel tube 106 will meet tangentially with the top surface of the pilot light tube 102. If this tube 102 is set too high, too much of the gas from the pixel tubes 106 will run into it and not over it, and if it is set too low some of the bursts of gas from the pixel tubes 106 may fail to fully ignite.

In the embodiment described above, all electronics and valves are housed in the lower portion of the frame 108, and all gas for the pilot lights and pixel tubes 106 is routed up the sides of the frame 108 and then into channels that span across the frame horizontally. This layout provides the benefit of a semitransparent screen, where most of the space inside the frame is empty and can be looked through, contributing to the illusion that the graphics and text of fire are floating in air on a formless plane. In addition, the housing of all sensitive components in the lower base provides nearly total shielding from the heat and virtually eliminates thermal concerns for those sensitive parts. For certain applications though, it may be desirable to employ a different, second embodiment of the pyrotechnic matrix, whereby a solid back plate blocks line-of-sight and heat, and the solenoid valve for each pixel is set directly behind each pixel tube 106 on the rear of the back plate, with the valve bus spanning the rear of the screen.

Figure 9:
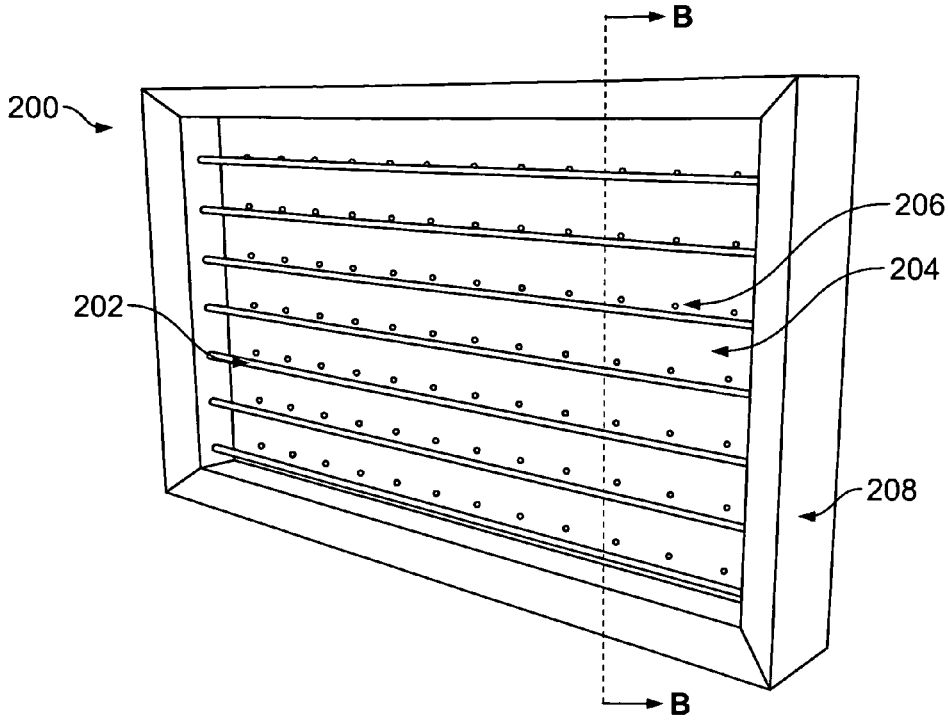
FIG. 9 is a perspective view of a second embodiment of a pyrotechnic matrix according to the invention.

FIG. 9 is a perspective view of this second embodiment, screen 200, of a pyrotechnic matrix according to the invention. In this embodiment, the frame 208, the electrical box, electrical connections, valves 210, and all elements of the pilot light system including pilot light tubes 202, pilot light bus, venturi, and pilot and valve gas supply lines, may be identical to the corresponding elements described in screen 100 of the previous embodiment. Screen 200 however omits the crossbars 104 and instead includes a back plate 204 of solid metal, roughly 1/8 inch thick, covering the entire area enclosed by the frame 208, and attached to it. Each of the pixel tubes 206 terminates in its same position as described in screen 100, relative to the frame and corresponding pilot light tube 202. But in the embodiment of screen 200, these pixel tubes 206 terminate just after passing through holes in the back plate 204, with a protrusion of the pixel tubes 206 of roughly 0.25 inch.

Figure 10:
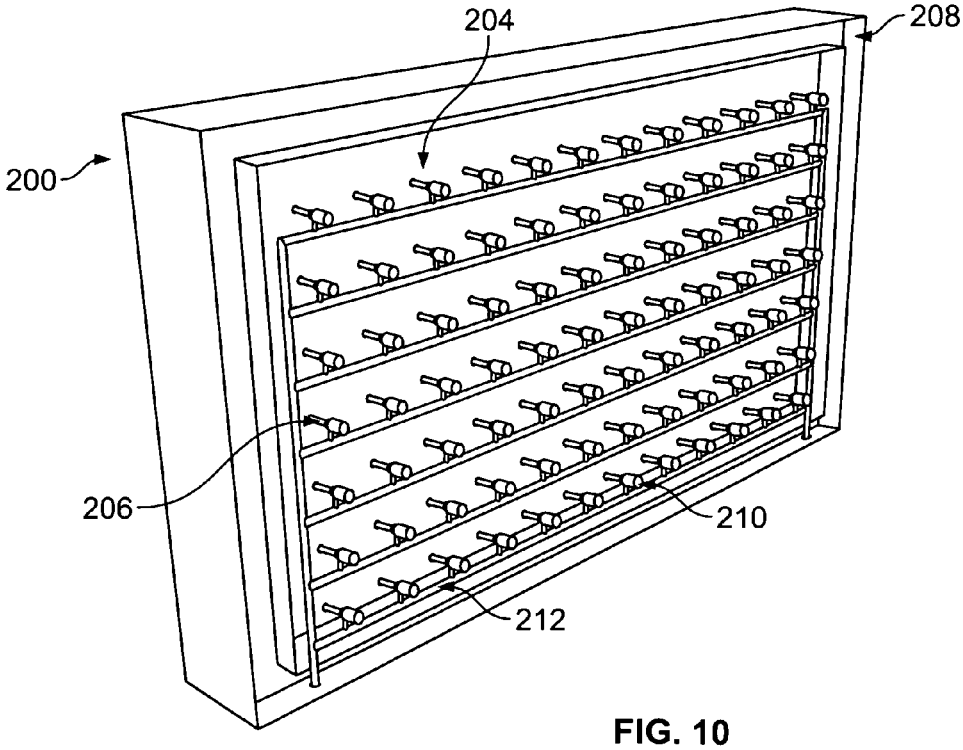
FIG. 10 is a rear perspective view showing the valve array of the embodiment of FIG. 9.

FIG. 10 is a rear perspective view showing the valve array of the embodiment of FIG. 9. Whereas in the previous screen 100 the solenoid valves 118 were all grouped in the base of the frame and their outputs were routed through long pixel tubes 106 to the pixel's location, in this screen 200 each solenoid valve 210 is positioned a few inches behind the terminus of its pixel tube 206. The pixel tubes 206 are therefore short and straight, but should still be made of metal due to the extreme thermal conditions they must endure. Whereas in screen 100 the valve bus 122 was optimized for tight spacing within the frame 108, in the present screen 200 the valve bus 212 is expanded to cover the entire rear of the screen, with horizontal or vertical rows supplying gas to the pixels at regular, evenly-spaced locations along the grid. The valve bus 212 should be constructed of pressure-rated, rigid conduit, and will structurally support the array of valves. In this way, the bus and valve array may be easily removed for transport or maintenance and reattached by passing the pixel tubes 206 through their corresponding holes in the back plate 204, and securely fastening the valve bus tubes 212 to the frame 208 or back plate 204. As described in the previous screen 100, gas supply for the valve bus comes from an external source, regulated to a maximum of 5 to 10 psi. The gas supply tube or hose enters the frame 208 and is distributed to the valve bus 212.

Figure 11:
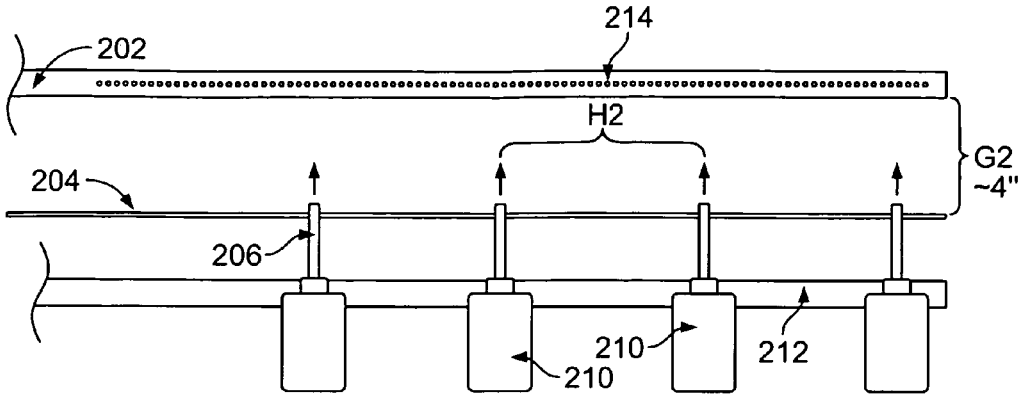
FIG. 11 is a top plan diagram illustrating the layout of pilot light tubes, crossbars, and pixel tubes of the embodiment of FIG. 9.

FIG. 11 is a top plan diagram illustrating the layout of pilot light tubes, back plate, and pixel tubes of the embodiment of FIG. 9. As mentioned above, the pilot light tubes 202, pilot holes 214, horizontal and vertical pixel spacing 'H2' and 'V2' (roughly 6 inches), and horizontal spacing 'G2' (roughly 4 inches) between the pilot light holes 214 and the termini of the pixel tubes 206 are all identical to those described in the previous embodiment screen 100. In this figure though we see the back plate 204 behind which sit the valves 210 and valve bus 212, and through which pass the pixel tubes 206.

Figure 12:
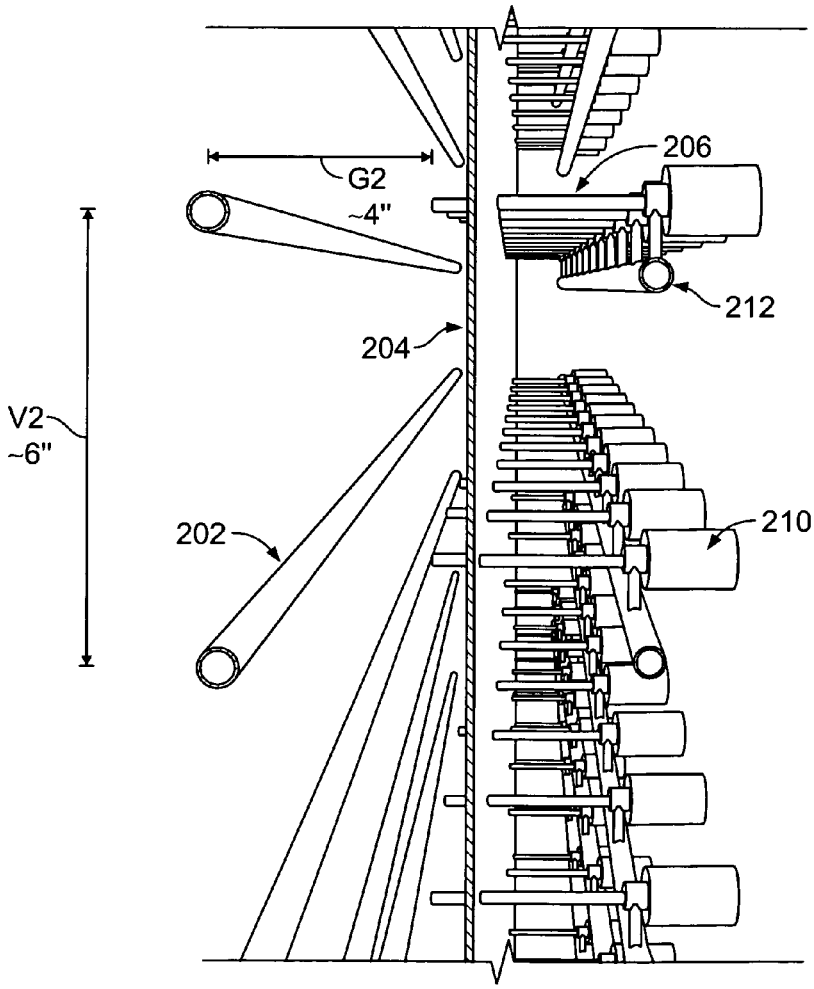
FIG. 12 is a sectional perspective view of the pilot light tubes, crossbars, and pixel tubes, taken in the direction of line B-B in FIG. 9.

FIG. 12 is a sectional perspective view of the pilot light tubes, back plate, and pixel tubes, taken in the direction of line B-B in FIG. 9. Again, as in screen 100, the pilot light tubes 202 are set forward of the termini of the pixel tubes 206 by about 4 inches, but are also set slightly lower than the tubes, such that a horizontal line extended out the terminus of a pixel tube 206 will meet tangentially with the top surface of the pilot light tube 202. This figure also illustrates how the valves 210 each tap into the valve bus 212 with a rigid, pressure-rated conduit connection.

The two embodiments described above in screens 100 and 200 employ mostly the same components, in varying configurations, to achieve the same end effect, albeit with some advantages and disadvantages to each design. In the embodiment of screen 100, sensitive components are better protected thermally by residing in the base of the frame, below the heat of the upward convections created when the device is operating. Furthermore the open back of the screen 100 with only pilot light tubes 102 and crossbars 104 traversing the screen area gives the screen itself a more intangible feel and makes the graphics and text of fire seem to emerge from and float on an invisible plane in front of the screen. This see-through design is also more aesthetically appealing in some cases, and can allow a large screen to exist without completely blocking line-of-sight.

The second embodiment of screen 200 has some advantages of its own as well. In outdoor conditions with high wind, it may become possible for the pilot lights to get blown out by the force of air passing over them. With the open back of screen 100, the wind is free to pass right through the screen, but with the back plate 204 of screen 200, such free flow is not possible. Wind may still be able to reach the pilot tubes in front of this back plate, but without such free flow, the total velocity of wind passing over the pilot light tubes 202 is greatly reduced, as is the risk of them blowing out in a wind of any given velocity. In addition, while the open back and crossbars of screen 100 may be more aesthetically appealing in some situations, there may be other situations in which the closed back of screen 200 is desirable, in order to block the line-of-sight through to the other side of the screen, or to create more of the effect of a solid wall. Electronics are still housed in the base of the frame 208 of screen 200, but with the potentially heat-sensitive valves 210 positioned inches behind the back plate 204, across the entire back of the screen, thermal concerns are raised slightly. While the back plate 204 reflects a good deal of the radiant heat coming from the front of the sign, it still absorbs heat itself and radiates and conducts that heat back through the pixel tubes 206 and into the valves, and for this reason such a configuration as screen 200 may call for the use of more specialized solenoid valves, rated not only for gas at 10 psi, but also for operation in elevated temperature ranges. Finally, the valve bus 212 layout of screen 200 provides numerous logistical advantages over the valve bus 122 layout of screen 100. Whereas the valve bus of screen 100 is optimized to fit in a minimum amount of space within frame 108, and is difficult to access when positioned inside the frame, the valve bus of screen 200 is spread across the entire space of the back of the screen. This allows for easier construction by avoiding the tight space within the frame 208, as well as providing a mechanism whereby the entire valve bus 212 may easily be detached and removed entirely from the frame 208 and back plate 204, for purposes of transportation or maintenance on any of the parts of the valve array.

Figure 13:
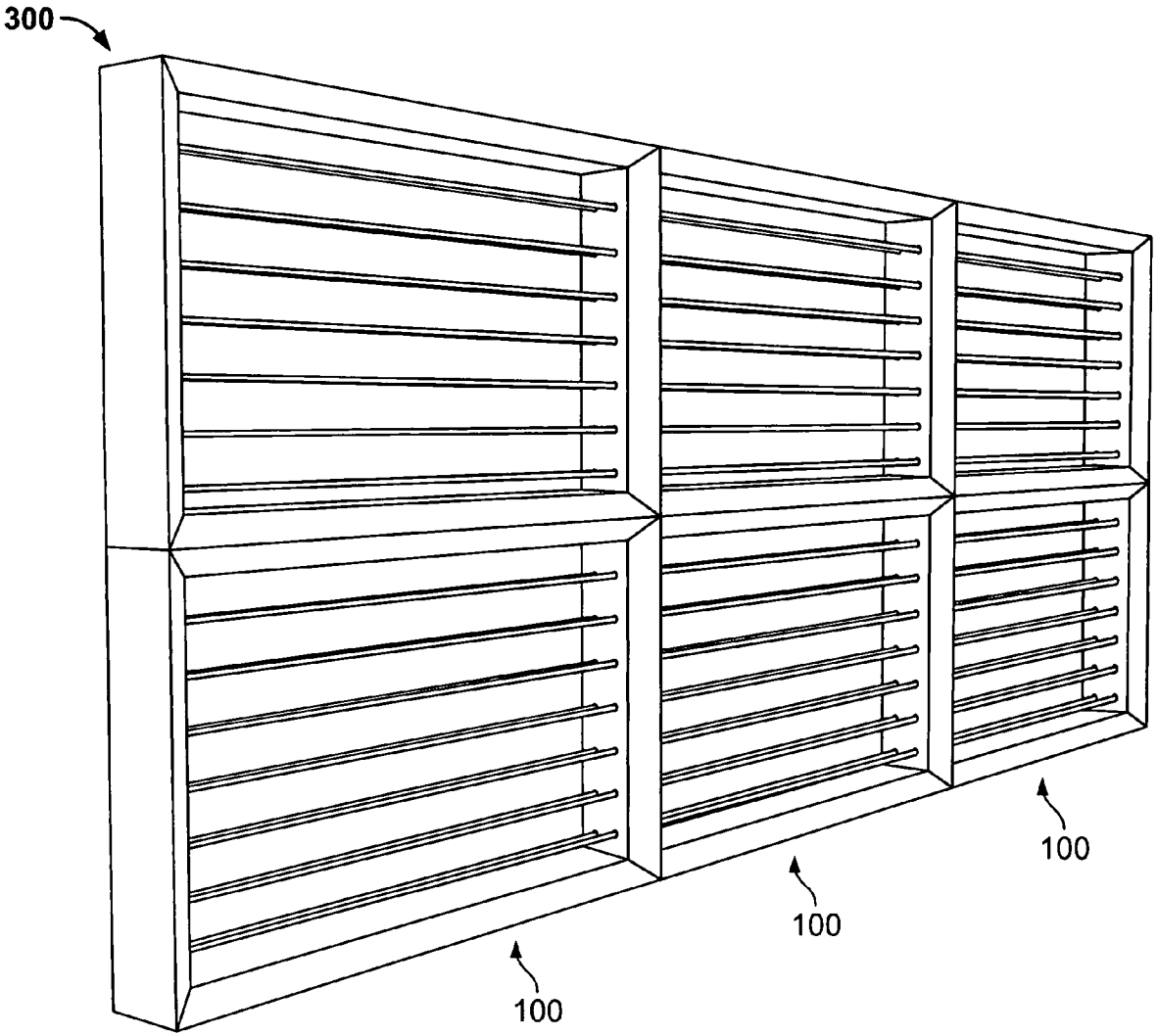
FIG. 13 is a perspective view of a third embodiment of a pyrotechnic matrix, involving the combination of multiple units into one, according to the invention.

The previous two embodiments have described varying forms of the same basic parts to create a nearly identical effect, but the third embodiment of the present invention involves the combination of multiple identical screens to form a larger screen that functions as a single unit. FIG. 13 is a perspective view of such an embodiment, combining 6 individual units of screen 100 (though units of screen 200, or any variations on the two could be used as well) to form a single larger screen 300. Such a flexible configuration requires the controlling software to be able to adapt easily with user input to alter its output and switch from addressing the number of pixels on a single unit, to addressing the number of pixels on the multi-screen unit. In addition, the output of the computer must allow for the increased number of circuit boards with which it communicates, and address them in a manner that accounts for each individual screen unit's spatial location within the screen area of the larger unit 300. Once again, the overall form of the large screen need not be restricted, either to a 2 by 3 unit array as pictured in FIG. 13, or even to a rectangular form at all. With such a multi-screen design, the only limitation is in the software, and what configurations of individual screen units it is programmed to recognize and control properly. Multiple-screen units may even reach sizes in the range of dozens of units high by dozens of units wide, but with larger multi-screens come a few increased structural and thermal concerns. Screen units are presumed to positioned on a secure floor or mounted on a wall or stand, but when units begin to be stacked vertically more than two units high, the structural stability of the whole unit must be accounted for, both with reinforced construction of the screen frames 108 or 208, and with the addition of brackets between individual units and/or the attachment of a metal superstructure or stand to aid in keeping the multi-screen unit solid, intact, and upright.

With the vertical span implied in some multi-screen units, other thermal issues may arise that require adjustments to be made to the design. Over a height of dozens of feet, the heat rising and radiating from all the lower pixels may accumulate and spread out to act as barbeque for units higher up on the multi-screen. When such conditions occur, the design of screen 100 with its valves enclosed in the base of the frame 108 may in fact subject those valves to increased heating from the firing of pixels on units below. The use of the design of screen 200 with its valves 210 protected behind the back plate 204 will reduce this occurrence, but still, over an accumulated height, the thermal accumulation and radiation will be increasingly great and for such conditions more specialized, heat-resistant valves should be used. Also, the valve and pilot light gas supply lines that are normally simply routed into the frame of a screen unit may need to adapted for increased heat resistance and for routing of the conduit up behind the multiple lower units before reaching the destination unit.

The materials available and suitable for construction of the various embodiments of the invention are varied. Most of the structural elements such as the frame 108 and 208, back plate 204, and crossbars 104, are presumed to be a metal such as mild steel, stainless steel, or aluminum. These metals can easily be welded for fabrication and provide adequate strength while maintaining a fireproof construction. The gas supply conduits are also presumed to be metal for reasons of pressure rating and heat resistance, and can include steel, copper, or brass tubes or pipes. The connections between these pipes and with the valves and devices they supply may be welded or soldered connections or utilize threaded pipe, so long as all joints are made pressure-tight (with the use of thread tape for threaded pipe). In some cases, such as single-screen use where cumulative thermal levels are lesser, components outside the screen and in the base of the frame may be safely compromised by using non-metallic parts, such as hoses for connecting the various gas supply lines, as long as all components are rated for gas pressure of 10 psi and can be safely employed given the specific conditions.

The circuit box 116 houses a single circuit board, with a power cable supplying voltage from an external battery or wall outlet to power the circuit board itself and to power the actuation of the solenoid valves. The control cable from the computer enters and connects to the circuit board as well, and depending on the computer output port used, may pass through a de-multiplexer circuit to decode control data and distribute it to the appropriate pixels. The circuit utilizes a number of addressable electronic "latches" to turn power on and off to each of the pixels' valves, and leave the valves' power in that state (on or off) until each is addressed again by the computer. The system hereby achieves a type of multiplexing. When power is sourced to a particular valve, current flows from the power source, through the circuit, and through the solenoid, actuating the valve. The valve will stay energized and actuated until the computer addresses it again and turns power off. The computer is able to address thousands of pixels per second, and so can create precisely timed bursts of gas through the valve, with an accuracy of a few milliseconds. In a typical operation, the computer will address all the pixels of the device nearly simultaneously, then wait a given amount of time (usually from 10 to 100 milliseconds) and address them all again, turning off the appropriate ones and turning on specified new pixels.

The software on the computer allows convenient and precise control over all screen functions, as well as allowing the on-the fly fine-tuning necessary for a precise pyrotechnic device such as this. Several different modes of operation are apparent, though a nearly unlimited number of new methods for creating, displaying, and interacting with graphics and sound are possible within the spirit of this invention. Examples of modes of operation follow.

Text Mode—A text mode makes the sign perform like a classic scrolling sign—simply enter an unlimited amount of text on the control screen, and instantly the sign cycles through the text, at whatever speed chosen. As the letters step sequentially across the screen, the user can even adjust the exact timing of each burst from approximately 15 to 100 milliseconds, to achieve either a strobed effect, or a more fluid, interlaced motion. Text mode features an additional function that allows the user to push any key on the keyboard and have the screen display that character as long as the key is held.

Tracker Mode—Tracker mode serves as a sort of freehand sketch function for the pyrotechnic matrix. With the computer mouse, the user clicks and drags within an onscreen box, and the device ignites the corresponding pixels in real time, producing dramatic, rapid gestures and motions. This mode also includes a setting whereby the keys of the keyboard are made to correspond in a similar way to the pixels of the device. The user may drag his hand across the keyboard, or beat on the keys a bit, or play the device like a piano.

Percussion Mode—Whereas the preceding modes of operation involve harnessing fire for visual appeal, the percussion mode takes advantage of the concussive nature of each burst of fire to create complex custom rhythms. The combustion sound of a single pixel firing produces a small amount of percussion, but add more and more simultaneous bursts and the depth and amplitude of the shockwave increase rapidly. Now by firing different quantities of pixels, and pixels at specific locations on the screen, it is possible to create beats of varied pitch and amplitude. Again the software allows easy control of tempo and pulse length, so the user can optimize playback every time. Scripting and editing of a percussion arrangement is easily handled with the percussion editing mode—the user may simply hit record and play along with the metronome on the keys of the computer keyboard. When complete he sees a visual representation of each beat, and is able to edit each beat's exact timing, volume, and location, as well as building up more beats on top. Then the file may be saved and played back any time. A benefit to using combustion for percussion is that much lower frequencies can be achieved than with most any standard percussion instrument. Frequencies at and below the threshold of human hearing dominate in the larger bursts, producing a far reaching, powerful bass sound.

Animation Mode—In Animation mode the device functions much like a regular TV screen, albeit at low resolution. Many simple animations can be been written played back by selecting from a menu. Again, speed and pulse length are variable, and the action can be looped or reversed. The software also includes a convenient animation editor which allows existing animations to be edited, and new animations to be created by sketching each frame on a grid and compiling those frames into a whole animation.

Audio Mode—Lastly, the Audio mode turns the device into a 12-bar audio level meter, similar to an audio visualization program with each bar tracking different frequency ranges and displaying the real-time result onscreen. This mode accepts music, voice and noise played on the computer, through a microphone, or simply from ambient sounds, and displays a constantly changing waveform corresponding to the tone and volume.

While the present invention has been described with reference to such specific embodiments, it will be understood by those skilled in the art that various changes may be made and equivalents may be substituted for elements thereof without departing from the true spirit and scope of the invention. In addition, modifications may be made without departing from the essential teachings of the invention.

The invention claimed is:

1. A computer-controlled pyrotechnic matrix display device, comprising:

a frame a backplate having a first surface and a second surface, the backplate disposed in the frame;

an array of pixels, comprised of individual tubes set within the frame, arranged in a grid having at least two dimensions, each dimension having at least two pixels;

an array of solenoid valves for controlling a flow of a flammable gas from a common input to termini of individual pixel tubes and directly into open air, the solenoid valves located on a first side of the backplate;

an array of pilot light tubes positioned in front of the termini of the pixel tubes such that flammable gas exiting the pixel tubes contacts flames from the pilot light tubes and combusts, thereby creating a fireball, the pilot light tubes located on a second side of the backplate;

a computer having control software to permit convenient scripting and control of all functions, which outputs control data through a parallel, serial, or USB port, said software controlling creation of designs in at least said two dimensions using said pixels; and a circuit board which processes incoming control data from the software and uses the data to actuate and de-actuate the solenoid valves with precise timing.

2. The device according to claim 1, wherein the solenoid valves and the circuit board are arranged in the frame and are operative to deliver gas to the termini of individual pixel tubes through conduit running from the frame to a location of each pixel.

3. The device according to claim 1, and further comprising a solid panel mounted on a back of the frame, each solenoid valve being positioned behind the panel adjacent to an assigned pixel location and supplied with gas from a common source.

4. The devices according to claim 1, wherein the frame, pixel tubes, solenoid valves and pilot light tubes together form a frame unit, wherein a plurality of the frame units are arranged and/or stacked to form a single screen unit, and the control software is able to adapt its output to address all the frame units and produce a single, coherent graphical and percussive display across the multi-frame units.

5. The device according to claim 1, and further comprising cross-bars that extend between lateral sides of the frame, the cross-bars having holes through each of which one of the pixel tubes projects.

6. The device according to claim 5, wherein spacing between the cross-bars and spacing between the pixel tubes is equal.

7. The device according to claim 1, wherein the circuit board is arranged in a bottom region of the frame.

8. The device according to claim 2, wherein a venturi is arranged in the conduit.

9. The device according to claim 1, wherein the pilot light tubes are about six inches apart.

10. The device according to claim 1, wherein the pilot light tubes each have a plurality of holes arranged in a straight line on a top of the tube and spaced no more than ⅛ inch apart.

11. The device according to claim 5, wherein the pilot light tubes are arranged about four inches from the cross-bars.

12. The device according to claim 1, wherein each of the pilot light tubes is set lower than an associated one of the cross-bars so that a horizontal line extending from an end of a pixel tube meets tangentially with a top surface of the pilot light tube.

13. The device according to claim 10, wherein the holes in the pilot light tubes have a diameter of no more than 1/16 inch.

14. The device according to claim 3, wherein each of the pilot light tubes is set lower than associated pixel tubes so that a horizontal line extending from an end of a pixel tube meets tangentially with a top surface of the associated pilot light tube, the top surface of the pilot light tube having a plurality of holes arranged in a straight line.

15. The device according to claim 1, wherein and further comprising a gas source connected to the pixel tubes and the pilot light tubes.

16. The device according to claim 3, wherein a valve bus connects together the solenoid valves.

* * * * *